United States Patent [19]

Ursetta

[11] Patent Number: 4,798,298

[45] Date of Patent: Jan. 17, 1989

[54] APPARATUS FOR GRIPPING SKIS OR LIKE

[76] Inventor: Chris H. Ursetta, 5800 Owensmouth #79, Woodland Hills, Calif. 91367

[21] Appl. No.: 114,507

[22] Filed: Oct. 30, 1987

[51] Int. Cl.[4] ..... A47F 5/08

[52] U.S. Cl. ..... 211/70.5; 211/89; 248/316.3; D6/552

[58] Field of Search ..... 211/70.5, 89; 248/316.2, 316.3; D6/552

[56] References Cited

U.S. PATENT DOCUMENTS

| | | | |
|---|---|---|---|
| D. 240,487 | 7/1976 | Blair | D6/552 |
| 994,790 | 6/1911 | Richards | 248/316.3 X |
| 1,306,585 | 6/1919 | Proege et al. | 248/316.3 X |
| 1,589,616 | 6/1926 | Alford | 248/316.3 X |
| 1,609,666 | 12/1926 | Settevig | 248/316.3 X |
| 2,370,876 | 3/1945 | Richardson | 248/316.3 X |
| 2,869,209 | 1/1959 | Kautzky | 248/316.3 |

FOREIGN PATENT DOCUMENTS

| | | | |
|---|---|---|---|
| 504185 | 7/1930 | Fed. Rep. of Germany | 211/65 |

*Primary Examiner*—Robert W. Gibson, Jr.
*Attorney, Agent, or Firm*—Frank L. Zugelter

[57] ABSTRACT

A ski gripping apparatus into which a pair of skis is thrust, after which the weight of the skis forces its gripping members to grip the skis to retain them in the device. The device comprises a pair of circular members eccentrically mounted on a support board which slips into an envelope of a backing member that is bolted to a wall. As a pair of skis is manually thrust into a channel between the circular members, these member eccentrically rotate about their corresponding shafts to widen the channel for disposition of the skis. Once the skis are disposed in such channel and the hands taken therefrom, spring biasing means in the members and support board cause them to eccentrically rotate back against the skis to grip them. Means limiting the eccentric motion of each of such members is provided in such members and support board, as well as pegs for ski-pole straps, which pegs also lock the support board to the backing member.

20 Claims, 2 Drawing Sheets

APPARATUS FOR GRIPPING SKIS OR LIKE

TECHNICAL FIELD

This invention is directed to an apparatus for supporting a pair of skis in a non-use mode, and is particularly directed to a wall-mounted device for gripping a pair of skis in such non-use mode.

BACKGROUND ART

Disclosures of these types of manufacture will be found in the following U.S. Pat. Nos. 2,919,032; 3,570,681; 4,222,490.

DISCLOSURE OF THE INVENTION

The invention comprises a gripping assembly eccentrically mounted upon a support plate which in turn is slidably mounted to a supporting bracket adapted for securement to a wall or the like. The gripping assembly in more particularity comprises a pair of spaced yet proximately related revolvable wheels or gripping members between which a pair of skis are to be gripped, held and supported. Each of these gripping members is eccentrically mounted upon a rod suitably secured to the support plate. These gripping members are counter-rotatable with respect to each other, so that upon insertion of a pair of skis into a channel generated by their positional dispositions on the support plate, they revolve upon their eccentrically mounted axis to open up such channel to receive the thicknesses of a ski or a pair of skis. Upon removing the skis from their supported disposition between the gripping members, the gripping members return to their proximate positions relative to one another. These gripping members are biased towards their proximate positions which is indicated by a minimal opening for the channel. A compressible spring is mounted in a wall of each gripping member which faces the support plate and compresses in the member's eccentric movement by reason of a fixed pin extending from the support plate to engage the spring. The compressed springs maintain a force to always eccentrically revolve the gripping members towards their proximate positions. Thus, skis are supported in the assembly whenever inserted between them while such members seek their proximate positions after removing the inserted pair of skis from between them.

Each of the gripping members is limited in its eccentric movement by means of another fixed pin extending from the support member into a slot provided in a wall or rear face of each gripping member. Further, a pair of pegs for hanging corresponding ski poles on the device also is part of the invention. They not only perform that function, but they also lock the support member in place on a mounting or bracket member. Each peg is threaded through the support member, with its end projecting into a corresponding hole in the mounting member in alignment with the end of the peg. The support member or plate slidably mounts within an envelope in the mounting member, to seat in a position so that the pegs are in alignment with the holes in the mounting bracket.

An object of this invention is to provide a novel ski support device.

Another object of this invention is to provide a relatively inexpensive, easy-to-assemble, and easily wall-mountable device.

A further object of the invention is to grip a ski or skis in a ski supporting device without the necessity of making a previous manual arrangement in the device for accepting the skis prior to their securement therein.

These and other objects and advantages of the invention will become more apparent by a full and complete reading of the following description, appended claims thereto, and the drawing comprising two (2) sheets.

BEST MODE FOR CARRYING OUT THE INVENTION

Figure 1:
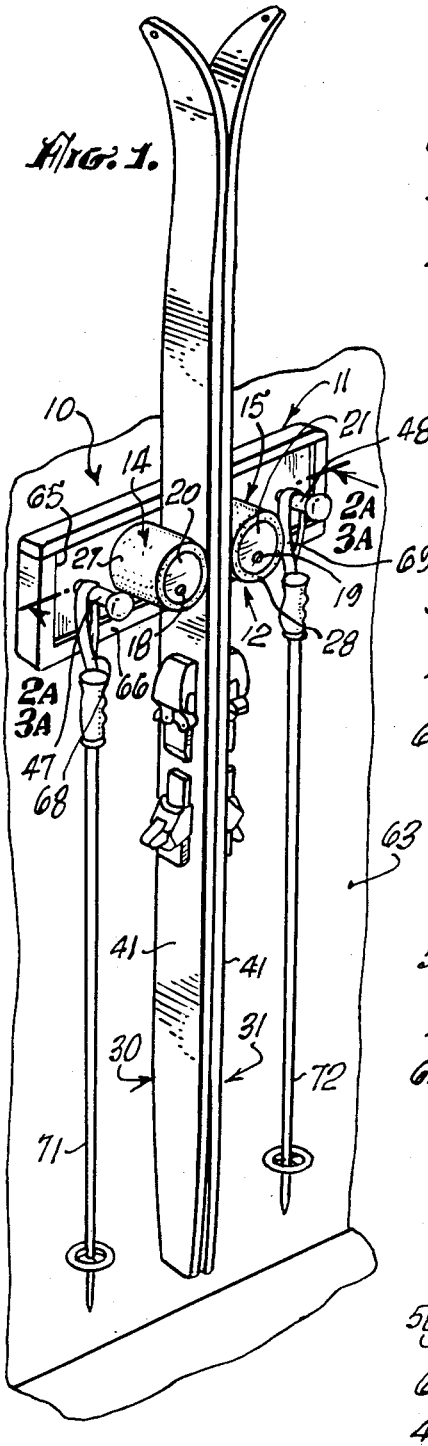
FIG. 1 is a perspective view of the subject matter of the invention, shown in assembly and operation.
Figure 2:
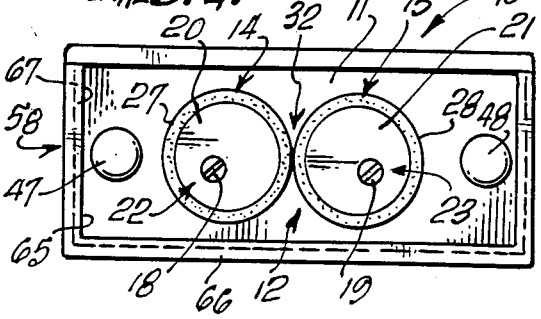
FIG. 2 is an elevational view of the subject matter of the invention, in a non-use mode of operation.
Figure 2A:
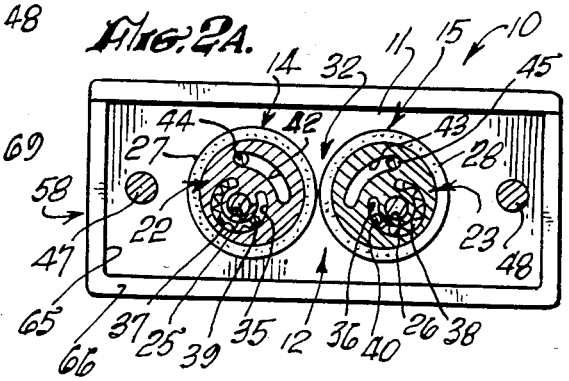
FIG. 2A is a view taken on line 2A—2A of FIG. 2.
Figure 3:
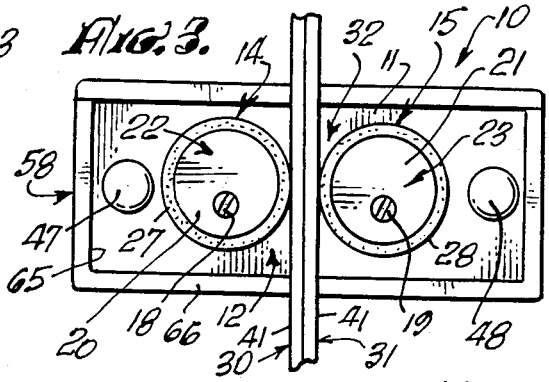
FIG. 3 is an elevational view of the subject matter of the invention in a use-mode of operation.
Figure 3A:
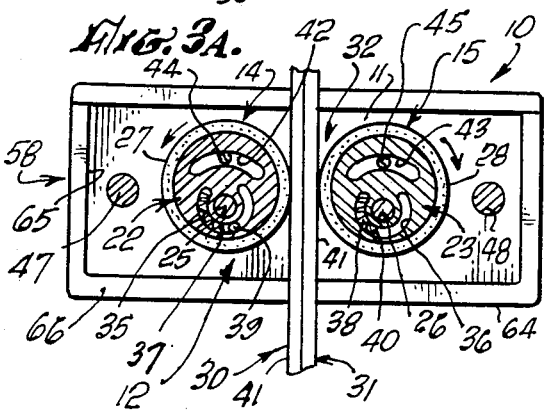
FIG. 3A is a view taken on line 3A—3A of FIG. 3.

Referring now to the drawing wherein reference characters correspond to like numerals hereinafter, 10 refers to a device or apparatus which embodys the invention. Apparatus 10 comprises, FIGS. 1, 4–6, a support 11 from which a gripping assembly 12 extends. Gripping assembly 12 comprises a pair of gripping members 14, 15 revolving about their respective eccentrically disposed axes represented by a pair of rods 16, 17 suitably secured in spaced relation to support 11. Preferably, rods 16, 17 include tapped ends for threading screws 18, 19 thereto, and which are counter-sunk in their corresponding front faces 20, 21 of gripping members 14, 15 to hold the latter in place on rods 16, 17. Each gripping member comprises a cylindrical core 22, 23 of hard material having bores 25, 26, respectively, for rods 16, 17 and which are off-set to their respective central axes in order to produce their desired and required eccentric movement. Rubber or other suitable facing material 27, 28, which are not abrasive to skis, are securely and suitably mounted to such core members for engaging their respective skis 30, 31 that are inserted into a variable-width opening for a channel 32 generated by the dispositions of the gripping members during operation.

Each core 22, 23 includes a corresponding wall or rear face 33, 34 which directly faces support 11. In each of these walls 33, 34, a curved slot 35, 36 is correspondingly formed at a distance from or about the eccentric mountings for members 14, 15, and represented by rods 16, 17 in their corresponding cylindrical bores 25, 26. A spring 37, 38 is respectively mounted in each of such slots 35, 36, while a pin 39, 40 securely mounted in support 11 extends forwardly thereof correspondingly into each of such slots 35, 36. Each of these pins 39, 40 engages the one end of its corresponding spring 37, 38 so as to provide a compressive force upon the eccentric movement in one direction of its corresponding gripping member 14, 15. This compressive force acts either against the corresponding top 41 of each of the skis 30, 31 inserted into channel 32 between such gripping members to grip them or returns its corresponding gripping member fully to its initial position at which there is a minimal opening of channel 32 between it and the other gripping member.

Another curved slot 42, 43 is formed also in its corresponding wall or rear face 33, 34 of its corresponding gripping member 14, 15, at a distance from or about its corresponding bore 25, 26. A corresponding pin 44, 45 securely mounted in support 11 extends forwardly thereof to project into its corresponding slot 42, 43. Thus, as each gripping member 14, 15 revolves about the axis of its corresponding threaded rod 16, 17, such eccentric movement is limited to the extent of the length of its correspondig curved slot 42, 43, as its corresponding pin 44, 45 strikes the body formation of its corresponding gripping member 14, 15 at the end of its corresponding slot.

A pair of ski pole pegs 47, 48 is securely mounted in place at opposing positions on support 11, i.e., to the outside of the adjacently positioned gripping members 14, 15. Each peg 47, 48 includes a threaded portion 50, 51 which in turn is threaded to a corresponding threaded hole 52, 53 in support 11. A reduced end 54, 55 for each peg 47, 48 projects into a corresponding hole 56, 57 formed in a mounting member or bracket 58. In this manner, after support 11, preferably downwardly as shown, slides, preferably downwardly as shown, into an envelope 59 formed in bracket 58, or otherwise held in facing relation to such bracket 58, the peg ends 54, 55 can project into such holes 56, 57 to thereby retain member 11 and the gripping assembly 12 to the bracket 58. Mounting member 58 also includes additional holes 61 by which it is capable of being physically attached to a room wall 63 by conventional means such as molly-bolt fasteners (not shown).

It should be noted that curved slots 35, 42 and 36, 43 are formed along circular arcs about the axes of cylindrical bores 25, 26 and are generally in opposing relation to one another on their respective wall 33, 34 of gripping members 14, 15. However, the invention is not limited to this circular configuration of or the opposing relationship for such slots as illustrated in the drawing, in the event the gripping members' configurations themselves vary from their illustrated cylindrical natures. Various changes in the curvature of the slots and their positions are contemplated within the scope of the invention should such cylindrical natures change. Also, a minimal opening for channel 32 is preferred, although a minimum opening, including zero is contemplated.

In the preferred embodiment, mounting member 58 includes interiorly grooved side and bottom edges 64 which provide a depth to it, while retaining an open window 65 at its frontal face 66. Support 11 is of a thickness such as to slidably mount along and within side edges 64 and seat upon bottom edge 64, after which pegs 47, 48 are applied to the device to lock support 11 in the envelope 59 of mounting member 58 generated by the latter's thickness and grooved sides.

Figures 4, 5, 6, 7:
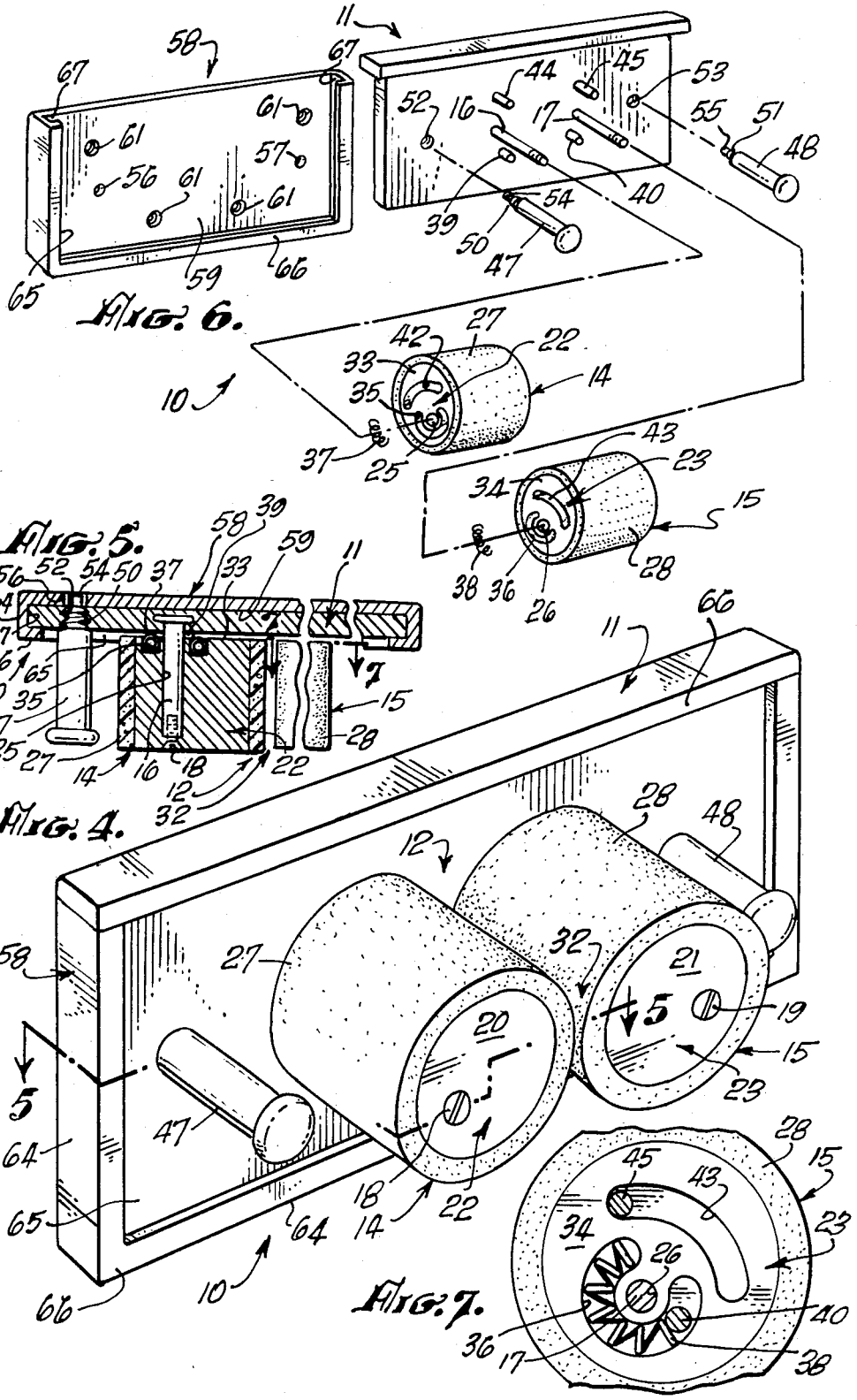
FIG. 4 is an enlarged perspective view of the device embodying the invention.
FIG. 5 is a view taken on line 5—5 of FIG. 4.
FIG. 6 is an exploded perspective view of the device embodying the invention.
FIG. 7 is a view taken on line 7—7 of FIG. 5.

Also in the preferred embodiment, slots 67, two of which are shown in FIG. 5, are formed in the rear wall of support 11, in line with holes 61 of bracket 58, in order to accommodate any projections of the molly-bolt or other fasteners used to secure bracket 58 to room wall 63, as support 11 is slid into place in envelope 59.

In operation, a pair of skis 30, 31 are placed together, bottom to bottom as shown in FIG. 1, and inserted or interjected into channel 32 of gripping assembly 12 mounted on support 11 secured in place in bracket 58 secured to a room wall 63. Such insertion is accomplished by an upward and inward thrust of such skis causing gripping members 14, 15 to eccentrically revolve about their respective rods 16, 17, in counter-rotation to each other, thereby enlarging the minimal opening of such channel to accommodate the thicknesses of the skis 30, 31. Upon manually releasing from one's grasp such skis, the combined compressive forces generated by springs 37, 38, which have been compressed by reason of engaging the stationarily positioned pins 39, 40, cause gripping members 14, 15 to grip the skis between themselves or their rubber facings 27, 28. Hand straps 68, 69 on ski poles 71, 72 are hung upon pegs 47, 48. To release the skis from gripping assembly 12, they are manually grasped, again thrust upwardly to eccentrically rotate gripping members 14, 15 in counter rotation to one another in the same direction as before, and readily withdrawn outwardly from assembly 12. The compressed springs 37, 38 return the gripping members 14, 15 to their initial or non-use mode at which the opening of channel 32 is minimal. Hand straps 68, 69 are manually removed from pegs 47, 48.

In assembly, bracket 58 is first secured to room wall 63, at suitable or desired height by means of utilizing, for example, molly bolts (not shown) in holes 61 provided in mounting member 58. Prior to sliding support 11 into envelope 59 of mounting member 58, pins 44, 45, 39, 40 are threadedly secured to support 11. Springs 37, 38 are inserted into their corresponding curved slots 35, 36. Rods 16, 17 are threadly mounted to support 11, and thereafter the corresponding cylindrical bores 25, 26 of the core members 22, 23 are mounted thereto, while simultaneously mounting curved slots 42, 43 upon their corresponding pins 44, 45; with pins 39, 40 being likewise simultaneously fitted to their respective curved slots 35, 36 at the one end of their corresponding spring 37, 38. Screws 18, 19 are threaded into the tapped ends of rods 16, 17. Then support 11 is slid into envelope 59 of bracket 58 so that pegs 47, 48 can be threaded through their respective holes 52, 53 and into holes 56, 57 of bracket 58, thereby completing the assembly.

Suitable materials are utilized to fabricate the various elements or components embodying the invention. The support and mounting members may be made of wood, plastic, or metal, as well as the cores 22, 23 and pegs 47, 48. The mounting pins 16, 17 and springs 37, 38 are formed from suitable metallic materials. Rubber or other suitable facing members 27, 28 are fabricated from rubber, plastic or other suitable materials which will not mark or damage the tops of skis 30, 31 that are applied to gripping assembly 12; however, the gripping members 14, 15 also may be made of one non-abrasive material to the skis if desired.

Industrial Applicability

The invention is utilized in the ski and recreational industry. The ski industry is not limited to recreational considerations, as they are considered for military, cross-country touring, and medical assistance patrols as well. Thus, the invention is applicable in these areas as well, although not limited thereto.

I claim:

1. In an article supporting apparatus including a support, at least one revolvable gripping member eccentrically mounted to said support to cooperate with a second gripping member mounted to said support and between which the article is to be supported, said revolvable member having a wall facing said support, the improvement characterized by a means for biasing said revolvable member towards a position defining a minimal width between said gripping members, said biasing means comprising (a) a curved slot formed in the wall of said revolvable member and about its eccentric mounting, (b) a spring mounted in said slot, and (c) a pin mounted in said support and extending into said slot to engage said spring.

2. The improvement of claim 1 further characterized by the inclusion of means for limiting the eccentric movement of said revolvable member mounted between it and said support.

3. In the improvement of claim 2, said limiting means comprising a second curved slot formed in said wall about the eccentric mounting of said revolvable member, and a second pin mounted in said support projecting into said second curved slot.

4. The improvement of claim 1 or claim 2 or claim 3 further characterized by means for mounting said support to a wall or the like mounted on said support.

5. The improvement of claim 4 characterized by means for positioning and locking said support to said mounting means.

6. In the improvement of claim 5 said positioning and locking means comprising at least one peg or the like being threaded to said support and having an end projecting through said support and into a hole formed in said mounting means.

7. The improvement of claim 4 wherein said mounting means comprises an envelope having an open frontal face, said support slidable into said envelope, with said gripping members projecting outwardly of such frontal face.

8. The improvement of claim 5 wherein said mounting means comprises an envelope having an open frontal face, said support slidable into said envelope, with said gripping members projecting outwardly of such frontal face.

9. The improvement of claim 6 wherein said mounting means comprises an envelope having an open frontal face, said support slidable into said envelope, with said gripping members projecting outwardly of such frontal face.

10. The improvement of claim 1 further characterized by said second gripping member having a wall facing said support, being revolvable, and being eccentrically mounted to said support.

11. The second improvement of claim 10 including a second means for biasing said second gripping member towards a position defining a minimal width with said one revolvable gripping member.

12. In the improvement of claim 11 said second biasing means comprising (a) a curved slot formed in the wall of said second gripping member and about its eccentric mounting, (b) a spring mounted in said curved slot, and (c) a pin mounted in said support and extending into said curved slot to engage said spring.

13. The improvement of claim 13 further characterized by the inclusion of a second means for limiting the eccentric movement of said second member mounted between it and said support.

14. The improvement of claim 13 wherein said second limiting means comprises a second curved slot formed in said wall about the eccentric mounting of said second member, and a second pin mounted in said support projecting into said second curved slot.

15. The improvement of claim 10 or claim 11 or claim 12 or claim 13 or claim 14 including means for mounting said support to a wall or the like mounted on said support.

16. The improvement of claim 15 further characterized by means for positioning and locking said support to said mounting means.

17. In the improvement of claim 16, said positioning and locking means comprising at least one peg or the like been threaded to said support and having an end projecting through said support into a hole formed in said mounting means.

18. In the improvement of claim 17, said mounting means comprising an envelope having an open frontal face, said support slidable into said envelope, with said gripping members projecting outwardly of such frontal face.

19. In the improvement of claim 16, said mounting means comprising an envelope having an open frontal face, said support slidable into said envelope, with said gripping members projecting outwardly of such frontal face.

20. In the improvement of claim 15, said mounting means comprising an envelope having an open frontal face, said support slidable into said envelope, with said gripping members projecting outwardly of such frontal face.

* * * * *

UNITED STATES PATENT AND TRADEMARK OFFICE

CERTIFICATE OF CORRECTION

PATENT NO. : 4,798,298

DATED : January 17, 1989

INVENTOR(S) : CHRIS H. URSETTA

It is certified that error appears in the above-identified patent and that said Letters Patent is hereby corrected as shown below:

On the Title Page, Item [54] and column 1, line 1,
The title should read as

-- AN APPARATUS FOR GRIPPING SKIS OR THE LIKE --

In column 6, line 14, read

"claim 13" as -- claim 12 --.

Signed and Sealed this

Eleventh Day of July, 1989

*Attest:*

*Attesting Officer*

DONALD J. QUIGG

*Commissioner of Patents and Trademarks*